United States Patent [19]

Shadwell

[11] Patent Number: 4,947,565

[45] Date of Patent: Aug. 14, 1990

[54] PICTURE FRAMING ASSEMBLY

[76] Inventor: Clyde E. Shadwell, Rte. 5, Box 245D, Bemidji, Minn. 56601

[21] Appl. No.: 307,350

[22] Filed: Feb. 7, 1989

[51] Int. Cl.[5] ..... A47G 1/06

[52] U.S. Cl. ..... 40/152; 40/158.1

[58] Field of Search ..... 40/152, 156, 152.1, 40/158.1, 642

[56] References Cited

U.S. PATENT DOCUMENTS

| | | | |
|---|---|---|---|
| 279,490 | 6/1883 | Lane | 40/152 |
| 1,092,499 | 4/1914 | Matsuo | 40/158.1 |
| 1,765,980 | 6/1930 | Kaufman | 40/152 |
| 2,173,753 | 9/1939 | Copeland | 40/156 |
| 2,839,857 | 6/1958 | Teller . | |
| 3,665,627 | 5/1972 | MacCluney | 40/152 |
| 4,237,633 | 12/1980 | Murrell | 40/158.1 |
| 4,640,030 | 2/1987 | Wood et al. | 40/152.1 X |

*Primary Examiner*—James R. Brittain

*Attorney, Agent, or Firm*—Dorsey & Whitney

[57] ABSTRACT

A rectangular picture frame that can be opened and closed repeatedly for mounting and changing the picture to be displayed in the frame. The picture framing device is characterized by a rigid backing sheet, which is hinge mounted along one edge of the frame and releasably secured to the frame along its other three edges with adhesive tape. A triangular corner section of the backing sheet is removed to allow for lifting of the backing sheet from a closed or seated position and swinging it about the hinged edge to provide access to the frame interior for inserting or changing pictures.

1 Claim, 2 Drawing Sheets

PICTURE FRAMING ASSEMBLY

BACKGROUND OF THE INVENTION

The invention is in the field of prefabricated, complete picture frames, most typically for photographs and prints, in which the picture can be quickly inserted into the frame, and the frame can be closed and sealed, ready for hanging, in a matter of seconds.

The invention is particularly useful and advantageous when sold and used in association with fast photographic developing services in that it allows the customer to quickly frame prints that have been quickly developed, thus providing complete fast service from negative to framed print.

The invention is also particularly convenient for those who desire to change the picture in the frame. The change can be made without destruction of any portion of the frame. The picture frame can be quickly opened, a new picture can be substituted for the previous one and the frame can be closed and sealed and immediately rehung, all within a matter of seconds.

Prior art framing devices have provided for interchange or substitution of one picture for another without destruction of the frame. Some patents that disclose such frames include Birch (2,598,755), Spertus (2,649,799), Teller (2,839,857), Cornelius (3,589,049), McCluney (3,665,627) and Williams (4,044,483).

These prior art patents do not provide the convenience and rigidity in holding, displaying and interchanging pictures provided by the present invention, nor do they provide the ease of manufacture of the present invention. The present invention can also be used with conventional frame cross sections, thereby retaining the traditional molded frame designs.

SUMMARY OF THE INVENTION

The present invention is a rectangular picture frame with a conventional recessed cross section for accommodating a rigid transparent sheet, usually glass, a picture for display and a rigid backing sheet, all seated in the frame recess. The invention provides for convenient accessibility to and closure of the recessed cross section for quickly mounting and changing the picture to be displayed. The invention includes a rigid transparent sheet seated in a forward position in the recessed cross section of the frame and a rigid backing sheet seated in the recessed cross section rearwardly of the transparent sheet. The backing sheet is hinged to the frame along one edge and is releasably secured to the frame along the other edges by means of adhesive tape extending across the joint between the backing sheet and the frame. Means is provided at a corner of the backing sheet, spaced from the hinged edge, for swinging the backing sheet about the hinged edge, thereby releasing the tape seal from three edges of the backing sheet and providing access to the recessed cross section of the frame for inserting, or removing and replacing, the picture to be displayed in the frame.

A mat can be placed between the transparent sheet and the backing sheet and an adhesive strip can be provided on the suface of the mat facing the backing sheet for releasably securing the picture to be displayed to the mat.

One manner of providing means at a corner of the backing sheet for swinging the backing sheet about its hinged edge to expose the recessed cross section of the frame is to remove a triangular corner section of the backing sheet, thereby allowing finger access to the edge of the backing sheet to pull or swing it out of the frame.

Adhesive tape is used for hinge mounting the backing sheet along one edge, as well as for releasably securing the other three edges of the backing sheet to the frame.

DESCRIPTION OF PREFERRED EMBODIMENT

Design and Construction

Figure 4:
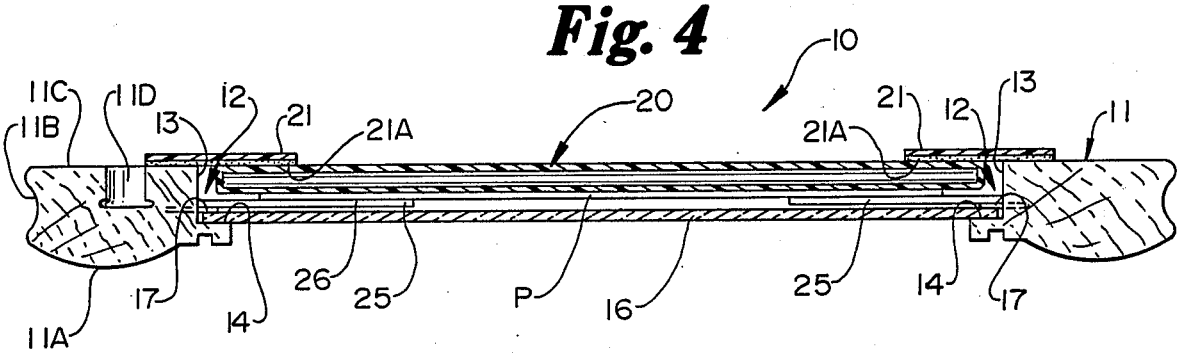
FIG. 4 is a sectional view taken on the line 4—4 of FIG. 3 and shows the recessed cross section of the frame with the transparent sheet, mat, picture and backing sheet seated therein.

The present invention 10 includes a rectangular frame 11 with a conventional recessed cross section 12, formed from transverse wall 13 and surface 14, best seen in FIG. 4. Frame 11 includes a front surface 11A, often molded, an outside edge 11B, also often molded, and a rear plane surface 11C. Frame 11 is provided with slots 11D for use in hanging the frame vertically or horizontally on a nail on a wall.

A rigid transparent sheet 16, most typically glass, is seated in recess 12 of frame 11 in engagement with surface 14 of recess 12, as best seen in FIG. 4. Transparent sheet 16 is held in position in recess 12 of frame 11 by means of glazier's points 17.

A rigid backing sheet 20 is seated in recess 12 of frame 11 covering substantially the entire rear opening in frame 11. Backing sheet 20 is releasably secured in a seated position in recess 12, and hinged across one edge thereof by means of adhesive tape 21 which includes adhesive 21A and extends across the joint between the edge of backing sheet 20 and frame 11 at wall 13 of recess 12. Tape 21 serves to hinge mount the left edge of backing sheet 20, as viewed in FIG. 4, to frame 11 at wall 13 and also to releasably secure the other three edges of backing plate 20 to frame 11.

Figure 1:
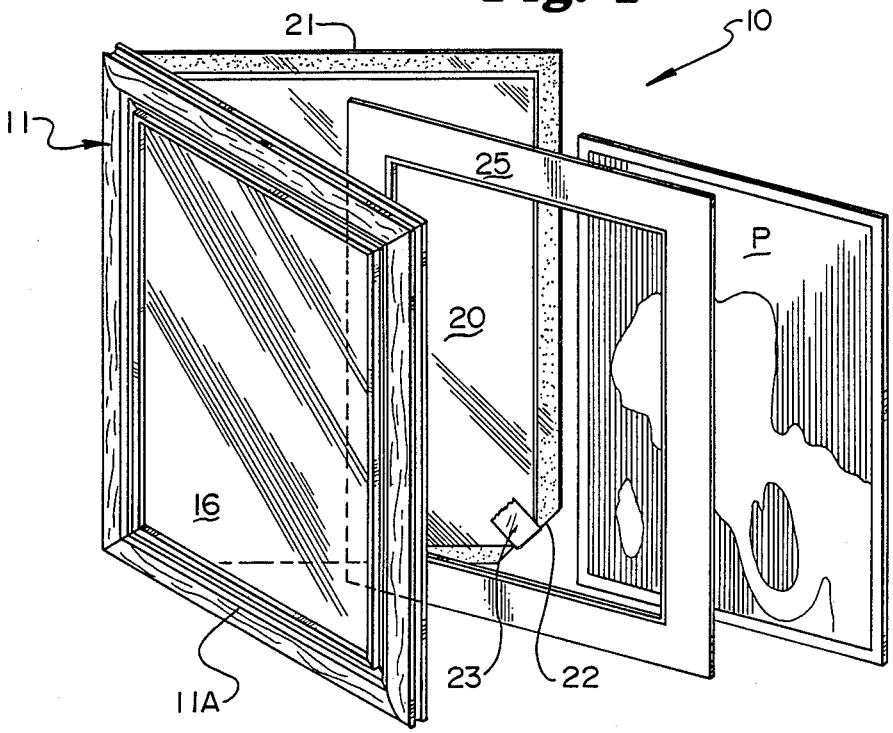
FIG. 1 is a front perspective view of the invention with the backing sheet in a hinged open position and the mat and picture shown in exploded position.
Figure 2:
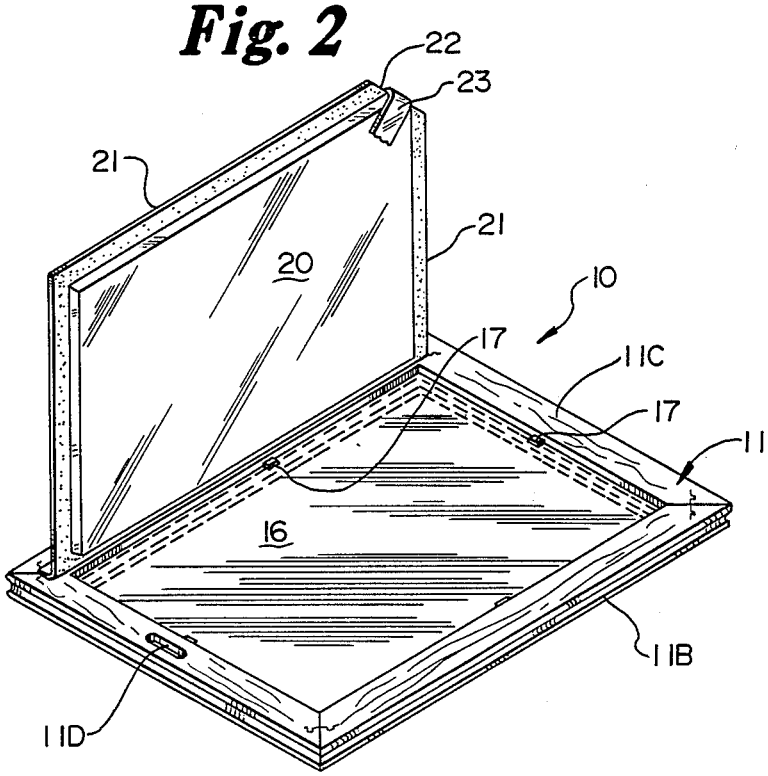
FIG. 2 is a rear perspective view of the invention with the backing sheet in a hinged open position, exposing the transparent sheet. The mat and picture are not shown in FIG. 2.
Figure 3:
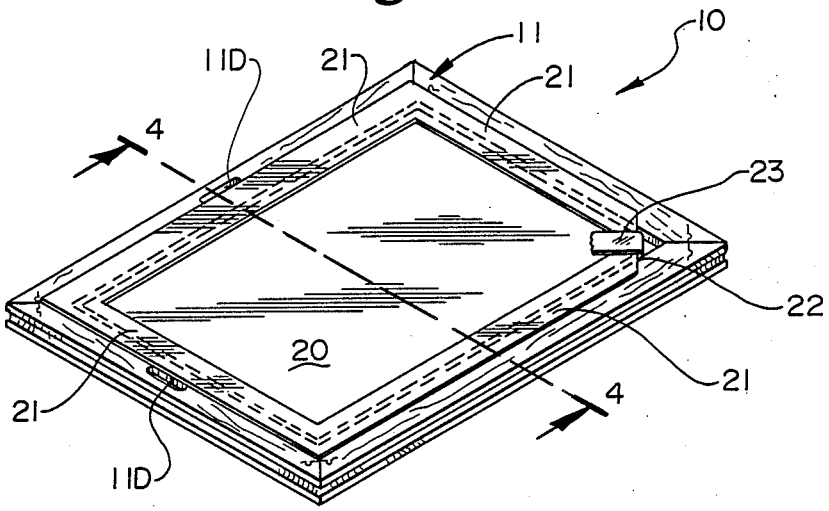
FIG. 3 is a rear perspective view of the invention with the backing sheet in a closed or seated position in the recessed cross section of the frame and with the adhesive tape engaging the rear of the frame, releasably holding the backing sheet in a position.

The hinging action of backing sheet 20 may be seen when comparing FIGS. 1 and 2, in which backing sheet 20 is hinged open, with FIGS. 3 and 4, in which backing sheet 20 is in a closed or seated position in frame 11.

A suitable adhesive tape for providing for repeated hinging action and for releasably securing backing sheet 20 in a closed or seated position is No. 8412 Polyester Film Tape, available from Minnesota Mining and Manufacturing Company, St. Paul, Minn.

Means 22 is provided for lifting one corner of backing sheet 20 from frame 11 in the form of cutting away a triangular section at one corner of backing sheet 20, as shown in FIGS. 1–3. A tape strip 23 may be placed across the diagonal edge of backing sheet 20, as shown in FIGS. 1–3, to prevent the edge from fraying as a result of repeated finger engagement for lifting backing sheet 20 to gain access to the recessed cross section 12 of frame 11.

A mat 25, shown in FIGS. 1 and 4, may be placed between transparent sheet 16 and backing sheet 19 for matting picture, P, which is placed between, mat 25 and backing sheet 19. An adhesive strip shown schematically by reference numeral 26 may be placed on the back of mat 25 to releasably secure picture, P, to mat 25, thereby locating picture, P, in a selected position for exposure through the opening in mat 25 and frame 11. A suitable tape for this purpose is Scotch Removable Magic Tape No. 811, available from Minnesota Mining and Manufacturing Company, St. Paul, Minn. ("Scotch Removable Magic Tape" is a trademark of Minnesota Mining and Manufacturing Company).

Use

In use, frame 11 of the present invention is opened from the closed position of FIG. 3 by inserting a finger in the triangular opening at 22 and lifting a corner of backing sheet 20, upwardly, thereby separating or releasing tape 21 from the back surface 11C of frame 11 along three of the sides of frame 11 and hinging or swinging backing sheet 20 along the fourth side into the open position shown in FIG. 2. Transparent sheet 16 and the recessed cross section 12 of frame 11 are thus exposed. Mat 25 and picture, P, may then be inserted into recessed cross section 12 between transparent sheet 16 and backing sheet 19. Picture, P, can be releasably secured to the back of mat 25 by adhesive, to fix the location of picture, P, with respect to the opening in mat 25. Backing sheet 19 is then swung into the closed position of FIGS. 3 and 4, and tape 21 is pressed into adhesive engagement with the back surface 11C of frame 11, thereby completing the mounting of picture, P, in frame 11. This is very quickly accomplished in a matter of seconds.

If a new picture is to be displayed, frame 11 can be opened, the old picture removed and a new picture inserted, all in the manner described above. A picture with a face or view on both sides can be utilized and simply turned around to change the picture in the frame. This, like the original mounting, can be accomplished in seconds.

The invention thus provides a frame for very quickly mounting and changing pictures for display in a frame, and the frame can be repeatedly opened and closed for repeated changing of the picture to be displayed.

Having thus described the invention, the following is claimed:

1. In a rectangular picture frame having a front and rear surface and a conventional recessed cross section for accommodating a rigid transparent sheet, a mat, a picture to be displayed in the frame and a rigid backing sheet, all seated therein, the improvement which provides for convenient accessibility to and closure of the recessed cross section for quickly mounting and changing the picture to be displayed, which comprises:

a. a rectangular transparent sheet seated in the recessed cross section of the frame and semi-permanently mounted to the frame, b. a rectangular, rigid backing sheet seated in the recessed cross section of the frame rearwardly of the transparent sheet, hinged to the frame along one edge thereof by means of adhesive tape extending across the joint between the edge of the backing sheet and the frame, and releasably secured to the frame along the other edges thereof by means of adhesive tape extending across the joint between the frame and the backing sheet, c. a rectangular mat seated in the recessed cross section of the frame between the transparent sheet and the backing sheet having an adhesive strip on the surface of the mat facing the backing sheet for releasably securing the picture to be displayed to the mat, and d. means providing for access to one corner of the backing sheet for swinging the backing sheet about the hinged edge thereof, thereby exposing the picture, said means consisting of the rectangular backing sheet having a triangular corner section removed.

* * * * *